US007540171B2

(12) United States Patent
Ino et al.

(10) Patent No.: US 7,540,171 B2
(45) Date of Patent: Jun. 2, 2009

(54) CRYOGENIC LIQUEFYING/REFRIGERATING METHOD AND SYSTEM

(75) Inventors: Nobumi Ino, Shiroi (JP); Takayuki Kishi, Inashiki (JP); Toshio Nishio, Moriya (JP); Akito Machida, Tsukubamirai (JP); Yoshimitsu Sekiya, Moriya (JP); Masami Kohama, Moriya (JP); Masato Noguchi, Toride (JP)

(73) Assignee: Mayekawa Mfg. Co., Ltd. (JP)

( * ) Notice: Subject to any disclaimer, the term of this patent is extended or adjusted under 35 U.S.C. 154(b) by 0 days.

(21) Appl. No.: 11/748,729

(22) Filed: May 15, 2007

(65) Prior Publication Data

US 2007/0251266 A1 Nov. 1, 2007

Related U.S. Application Data

(63) Continuation of application No. PCT/JP2005/003001, filed on Feb. 24, 2005.

(30) Foreign Application Priority Data

Nov. 15, 2004 (JP) ..... 2004-330160

(51) Int. Cl.
*F25B 1/00* (2006.01)
*F25B 27/00* (2006.01)

(52) U.S. Cl. ..... 62/611; 62/613; 62/238.3

(58) Field of Classification Search ..... 62/611, 62/613, 238.3
See application file for complete search history.

(56) References Cited

U.S. PATENT DOCUMENTS 3,389,565 A * 6/1968 Ergenc ..... 62/608

(Continued)

FOREIGN PATENT DOCUMENTS

JP 07-18611 B2 3/1955

(Continued)

OTHER PUBLICATIONS

Relevant portion on International Search Report, dated Apr. 5, 2005, issued in corresponding PCT application PCT/JP05/03001, filed Feb. 24, 2005.

*Primary Examiner*—William C Doerrler
(74) *Attorney, Agent, or Firm*—Rossi, Kimms & McDowell LLP

(57) ABSTRACT

Cryogenic liquefying/refrigerating method and system, wherein temperature of gas-to-be-liquefied at the inlet of the compressor for compressing the gas is reduced by cooling the gas discharged from the compressor using a high-efficiency chemical refrigerating machine and vapor compression refrigerating machine before the gas is introduced to a multiple stage heat exchanger thereby reducing power input to the compressor and improving liquefying/refrigerating efficiency. Gas-to-be-liquefied compressed by a compressor is cooled by aftercooler, and further cooled by an adsorption refrigerating machine which utilizes waste heat generated in the compressor and by an ammonia refrigerating machine 40, then the high pressure gas is introduced to a multiple-stage heat exchanger where it is cooled by low pressure low temperature gas separated from a mixture of liquid and gas generated by adiabatically expanding the high pressure gas through an expansion valve 30 and returning to the compressor, and a portion of the high pressure gas is expanded adiabatically by expansion turbines in mid-course of flowing of the high pressure gas through the stages of the heat exchanger to be joined with the low pressure low temperature gas returning to the compressor.

8 Claims, 5 Drawing Sheets

U.S. PATENT DOCUMENTS

| | | | | | |
|---|---|---|---|---|---|
| 3,611,740 | A | * | 10/1971 | Giger | 62/79 |
| 4,697,425 | A | * | 10/1987 | Jones | 62/46.3 |
| 4,819,445 | A | * | 4/1989 | Scherer | 62/238.3 |
| 6,158,241 | A | * | 12/2000 | Erickson | 62/613 |

FOREIGN PATENT DOCUMENTS

| | | | |
|---|---|---|---|
| JP | 60-44775 | A | 3/1985 |
| JP | 63-131960 | A | 6/1988 |
| JP | 10-238889 | A | 9/1998 |

* cited by examiner

CRYOGENIC LIQUEFYING/REFRIGERATING METHOD AND SYSTEM

CROSS REFERENCE TO RELATED APPLICATIONS

This is a continuation of International Application PCT/JP05/03001 (published as WO 2006/051622) having an international filing date of 24 Feb. 2005, which claims, priority to JP2004-330160 filed on 15 Nov. 2004. The disclosures of the priority applications are incorporated herein by reference.

TECHNICAL FIELD

This invention relates to a method and system for effectively reducing driving power of a compressor and minimize total power consumption for operating a cryogenic liquefying/refrigerating system such as a helium liquefying/refrigerating system and natural gas re-liquefying system, by effectively utilizing waste heat generated in the compressor and sensible heat of gas discharged from the compressor, such utilization being not performed in the past, by a chemical refrigerating machine and vapor compression refrigerating machine for producing cold medium for precooling the gas discharged from the compressor before the gas is introduced to a heat exchanger in a cold box.

BACKGROUND

In cryogenic liquefying/refrigerating apparatus of prior art, the compressor is positioned in room temperature environment, and gas-to-be-liquefied must be cooled to its liquefying temperature, i.e. boiling temperature (for example, about −269° C. in the case of helium) in the cooling section, so temperature difference is very large and refrigerating efficiency of the apparatus is remarkably low as compared with usual refrigerating machines. Therefore, a cooling medium (supplementary cooling medium) is introduced from outside the system in order to increase refrigerating efficiency. In the case of helium liquefying/refrigerating systems, liquid nitrogen is widely used as the supplementary cooling medium.

As a cycle for liquefying helium is known a closed cycle using helium as a refrigerant and a system capable of performing the cycle is disclosed in Japanese Laid-Open Patent application No. 60-44775.

FIG. 5 is a schematic diagram of the system disclosed in the above-mentioned JP 60-44775. In the drawing, reference numeral 01 is a heat-insulated cold box maintained under vacuum, reference numerals 02 to 06 are a first to fifth stage heat exchangers arranged in the cold box 01, 07 and 08 are respectively a first and a second expansion turbine, 09 is a Joule-Thomson (J/T) expansion valve, 010 is a gas-liquid separator for separating liquid helium from a mixture of liquid/gas helium. Reference numeral 012 is a compressor, 013 is a high pressure line, 014 is a low pressure line, 015 is a turbine line, and 016 is a precooling line in which liquid nitrogen flows for cooling the compressed helium gas.

In the helium liquefying/refrigerating apparatus of the prior art, high pressure high temperature helium gas discharged from the compressor 012 flows into the high pressure line 013 of the first stage heat exchanger where the helium gas is cooled by heat exchange with the liquid nitrogen flowing in the precooling line 016 and with helium gas flowing in the low pressure line 014, then flows through the high pressure line 013 of the second stage heat exchanger 03 to be further cooled. A portion of the high pressure helium gas which flowed out of the second heat exchanger 03 flows into the first expansion turbine 07, and the remaining portion flows through the high pressure line 013 of the third stage heat exchanger 04 to be further cooled, further flows through the fourth stage heat exchanger 05 and fifth stage heat exchanger 06 to be further cooled and flows into the J/T expansion valve 09.

The helium gas which entered the first expansion turbine 07 expands adiabatically therein to be rendered medium in pressure and low in temperature, then enters the second expansion turbine 08 after cooling helium gas flowing in the low pressure line 014 of the third stage heat exchanger 04, further expands in the second expansion turbine 08 to be rendered low in pressure and temperature, then flows into the low pressure line 014 of the fourth stage heat exchanger 05, thereby maintaining low helium gas temperature in the low pressure line 014. The high pressure low temperature helium gas reached the J/T expansion valve 09 experiences Joule-Thomson expansion there and partly liquefied, liquid helium 011 is stored in the gas-liquid separator 010, and remaining low pressure low temperature helium gas returns to the compressor 012 through the low pressure line 014 passing through the heat exchangers 06~02.

Japanese Laid-Open Patent application publication No. 10-238889, hereinafter patent literature 2, discloses a helium liquefying/refrigerating system in which an independent variable speed gas turbine electric generating system capable of efficient capacity control of a group of electric motor driven multi-stage compressors is added to a helium liquefying/refrigerating system mentioned above, thereby making it possible to utilize the cold source of the system and to recover waste heat of the system. The system comprises a gas turbine electric generating section including a frequency converter, a fuel supplying section, and a chemical refrigerating system, the chemical refrigerating system being composed to supply cold energy to the heat exchangers of the system utilizing waste gas of the gas turbine electric generating section as a heat source and the fuel supplying section comprising a heating device for gasifying a portion of liquefied natural gas supplied from a liquefied natural gas tank and a vaporizing section for supplying cold energy corresponding to latent heat of vaporization of the liquefied natural gas.

With the construction, improvement in thermal efficiency of the system is aimed at by generating electric power of optimal frequency and of homogeneous wave shape accommodating the combination of the group of multi-stage compressors so that each of induction motors for driving the compressors is driven at rotation speed to meet the demand from the load side thereby achieving optimal efficiency of the compressors, and by providing the gas turbine electric generating section using natural gas, for example, liquefied natural gas, the fuel supplying section, and the chemical refrigerating machine thereby combining the vaporizing section in which cold energy corresponding to latent heat of vaporization of the liquefied natural gas is generated and the chemical refrigerating machine in which cold energy is generated by utilizing waste heat of the gas turbine electric generating section.

SUMMARY OF THE INVENTION

Almost all of power input required for operation of cryogenic liquefying/refrigerating systems is for compressing the gas-to-be-liquefied. To reduce power input to the compressor for compressing the gas-to-be-liquefied, it is effective to lower the temperature of the gas-to-be-liquefied sucked into the compressor thereby reducing the specific volume of the gas. However, it is necessary to that end to cool the suction gas to a temperature lower than that of room temperature, and energy equipment such as refrigerating machine is required.

On the other hand, in a liquefying/refrigerating system of prior art, the high pressure high temperature gas discharged from the compressor is cooled to a temperature near room temperature (normal temperature) usually by a water-cooled after cooler before the gas is introduced to the heat exchangers provided in the cold box in order to prevent decrease in refrigerating efficiency of the system.

The high pressure gas discharged from the compressor and passing through the high pressure line and the low pressure gas passing through the low pressure line to be sucked into the compressor exchange heat with each other in each stage of the heat exchanger. Temperature of gas at the exit of each stage of the heat exchanger and that at the exit of each of the heat exchanger become about the same, though a little difference exists between both the temperatures. Therefore, gas temperature sucked into the compressor can not be lowered without reducing the temperature of the high pressure gas introduced to the first stage of heat exchanger in the cold box.

Therefore, power input to the compressor can not be reduced without reducing this temperature, and waste heat generated in the compressor, i.e. friction loss heat in the compressor and sensible heat of the high temperature high pressure gas is wasted without avail.

In the helium liquefying/refrigerating system of prior art shown in FIG. 5, helium gas of high pressure normal temperature discharged from the compressor 012 introduced to the first stage heat exchanger 02 through the high pressure line 013 and cooled by exchanging heat with liquid nitrogen introduced through the precooling line 016, running cost will be increased due to providing the precooling line for supplying liquid nitrogen, and furthermore, there remains problems that, as helium gas of near normal temperature is cooled as the gas flows through the plural stage of heat exchangers, a large number of stages of heat exchanger are necessary, and that as waste heat generated in the compressor 012 can not be recovered, refrigerating efficiency of the system is not increased.

In the case of a system using liquid nitrogen as a supplementary cooling medium, liquid nitrogen produced in a large-scaled nitrogen liquefaction plant is supplied by transportation means such as a tanker lorry. Therefore, there are problems in point of view of stable supply and running cost, and further, even if power input required for operating the helium liquefying/refrigerating system can be reduced, power input required to produce liquid nitrogen is larger than power input reduction in the system, so, total power consumed for operating the system increases.

In the helium liquefying/refrigerating system disclosed in the patent literature 2, thermal efficiency of the system is increased by supplying the cold energy generated by the chemical refrigerating machine which uses the exhaust gas of the gas turbine electric generating section as a heat source and by supplying the cold energy corresponding to the latent heat of vaporization of liquefied natural gas to the heat exchangers. Latent heat of vaporization of liquefied natural gas is utilized instead of liquid nitrogen by these means, but there is no fundamental difference as compared with the system of prior art of FIG. 5 in which precooling is performed by liquid nitrogen introduced through the precooling line 016. Therefore, temperature of gas discharged from the compressor can not be lowered, and there remains the problem the same as that in the system of prior art of FIG. 5 that power input to the compressor can not be reduced.

In light of the problems mentioned above, the object of the invention is to minimize total power consumption and increase refrigerating efficiency of the system, by reducing power input required to drive the compressor which consumes a largest part of power input for operating the system through reducing specific volume of gas-to-be-liquefied sucked into the compressor by lowering temperature of the gas without reducing refrigerating efficiency of the liquefying/refrigerating system, by downsizing the system through reducing the number of heat exchangers for cooling the gas-to-be-liquefied, and by effectively utilizing waste heat generated in the compressor or power input to the compressor.

To attain the object, the present invention proposes a method of cryogenic liquefying/refrigerating including the steps of, precooling high temperature high pressure gas-to-be-liquefied discharged from a compressor, introducing the gas to a multiple-stage heat exchanger to be cooled sequentially, liquefying a portion of the gas by allowing the gas to expand adiabatically, and using low temperature low pressure gas not liquefied as cooling medium in the heat exchanger and then returning the gas to the compressor, in which the gas compressed by the compressor and precooled is further cooled by a chemical refrigerating machine which utilizes waste heat generated in the compressor as a heat source, and the cooled gas-to-be-liquefied is introduced to the multiple stages of the heat exchanger.

In the method of the invention, temperature of the low pressure low temperature gas returned to the compressor while cooling the high pressure gas-to-be-liquefied in the multiple-stage heat exchanger can be lowered by further cooling the high pressure gas-to-be-liquefied, which is discharged from the compressor and precooled, by the chemical refrigerating machine, which utilizes waste heat, i.e. friction heat generated in the compressor as a heat source, so that the high pressure gas is introduced to the heat exchanger at a reduced temperature.

It is preferable that the high pressure gas-to-be-liquefied cooled by the chemical refrigerating machine is further cooled by a vapor compression refrigerating machine, then the gas is introduced to the multiple stages of the heat exchanger.

The present invention proposes a cryogenic liquefying/refrigerating system including a compressor for compressing gas-to-be-liquefied with high temperature and high pressure, an after cooler for precooling the gas discharged from the compressor, a multiple-stage heat exchanger for sequentially cooling the precooled gas, an expansion valve for expanding the gas cooled in the multiple-stage heat exchanger to be changed to a mixture of liquid and gas, a gas/liquid separator for separating the liquid from the mixture and storing the liquid, and a return passage for returning the gas separated from the liquid in the gas/liquid separator to the compressor after it served as a cooling medium for the multiple-stage heat exchanger, in which the system further includes a chemical refrigerating machine utilizing as its heat source waste heat generated in the compressor to further precool the gas precooled by the aftercooler.

In the invention, a chemical refrigerating machine utilizing waste heat, i.e. friction loss heat generated in the compressor as a heat source is provided so that the high pressure gas-to-be-liquefied discharged from the compressor and precooled by the aftercooler is further cooled before the high pressure gas is introduced to a multiple-stage heat exchanger arranged in a cold box. Then the high pressure gas is cooled by exchanging heat with low temperature low pressure gas returning from a gas/liquid separator to the compressor.

Temperature of the low temperature low pressure gas can be controlled to a desired temperature by directing a portion of the high pressure gas to expansion turbines to be expanded therein and allowing the expanded gas reduced in pressure and temperature to join the low temperature low pressure gas returning from the gas/liquid separator to the compressor.

Temperature of the high pressure gas entering each stage of the multiple-heat exchanger is about the same as that of the low temperature low pressure gas exiting from each stage of the multiple-stage heat exchanger though there is some temperature difference between them. Therefore, temperature of the low pressure gas at the inlet of the compressor can be reduced by reducing temperature of the high pressure gas entering the first stage of the multiple-stage heat exchanger. The system attains reduction of power input to the compressor by effectively utilizing waste heat generated in the compressor, i.e. friction loss heat as a heat source of the chemical refrigerating machine.

As a result, according to the invention, total refrigerating efficiency (amount of liquefied gas or refrigerating capacity per unit power consumed) of the system can be increased. Temperature of the waste heat discharged from the compressor is 60~80° C. A chemical refrigerating machine such as an adsorption refrigerating machine and an absorption refrigerating machine has a feature of being able to recover waste heat. Cold water of 5~10° C. can be produced by the chemical refrigerating machine utilizing hot water of 60~80° C. by recovering waste heat generated in the compressor or utilizing sensible heat of the gas discharged from the compressor or utilizing both of these heat.

In the invention, it is preferable that a vapor compression refrigerating machine is provided to further cool the gas precooled by said chemical refrigerating machine before it enters the multiple-stage heat exchanger.

Further, it is preferable that a portion of a low temperature cooling medium cooled by the chemical refrigerating machine is further supplied to a condenser of the vapor compression refrigerating machine as a cooling medium for the condenser so that pressure is decreased in condensing process in the vapor compression refrigerating machine by decreasing temperature in the condensing process and refrigerating efficiency of the vapor compression refrigerating machine is increased.

Furthermore, it is preferable that there are provided a cargo tank for storing the liquefied gas introduced from the gas/liquid separator, and a compressor for compressing boiled-off gas evaporated in the cargo tank and a precooling line for introducing the boiled-off gas to the compressor and introducing the compressed boiled-off gas to the first stage of the multiple stage heat exchanger as a cooling medium so as to use the boiled-off gas evaporated in the cargo tank for cooling the high pressure gas-to-be-liquefied in the first stage of the multiple-stage heat exchanger and increase refrigerating efficiency of the total system.

In cryogenic liquefying/refrigerating systems as represented by helium liquefying/refrigerating systems, oil-flooded screw compressors are widely used. However, lubrication oil and a pressure sealing agent are injected into the compression space thereof in compressors of this type, so they can not be operated in extremely low temperature. Further, a heat pump used for producing a supplementary cold source will be decreased in coefficient of performance (refrigerating capacity/power input) below 1 when refrigerating temperature is lower than −40° C., and the lower the temperature is, the lower the efficiency is. Therefore, effect of reduction of power input of the total system is obtained when suction gas temperature is lowered to about −35° C.

Therefore, refrigerating with high energy-saving effect is made possible by recovering waste heat generated in the compressor and sensible heat of the high pressure gas discharged from the compressor and utilizing these heat to produce cold water of 5~10° C. by the chemical refrigerating machine. Although a vapor compression refrigerating machine can produce cold water of a wide range of temperature, its efficiency is lower than the chemical refrigerating machine when producing cold water of about 5~10° C. Therefore, it is effective to cool the gas-to-be-liquefied to a temperature of about −35° C. before introduced to the heat exchanger in the cold box.

Next, the basic configuration of the system according to the invention will be explained with reference to FIG. 1 comparing with the basic configuration of a system of prior art. FIGS. 1*a*, 1*b*, and 1*c* shows basic configuration of cryogenic liquefying/refrigerating systems when liquefying helium gas. FIG. 1*a* is a system of prior art, FIG. 1*b* is a system of the invention when an adsorption refrigerating machine as a chemical refrigerating machine is provided for further precooling the high pressure gas discharged from the compressor before entering the cold box, and FIG. 1*c* is a system of the invention when an adsorption refrigerating machine and an ammonia refrigerating machine as a vapor compression refrigerating machine are provided in parallel for further precooling the high pressure gas discharged from the compressor before entering the cold box.

In FIGS. 1*a, b*, and *c*, reference numeral 021 (21) is a cold box for keeping inside space thereof in low temperature. In the cold box is arranged vertically a multiple-stage heat exchanger consisting of a first stage 022 to a $6^{th}$ stage 027 in the case of FIG. 1 (a first stage 22 to $5^{th}$ stage 26 in the case of FIG. 1*b* and a first stage 22 to $4^{th}$ stage 25 in the case of FIG. 1*c*). Reference numeral 028, 029 (28, 29) are respectively a first and second expansion turbine, 030 (30) is a Joule-Thomson expansion valve, 031 (31) is a gas/liquid separator for separating liquid helium from a mixture of liquid/gas helium. Reference numeral 033 (33) is a compressor, 034 (34) is a high pressure gas line, 035 (35) is a low pressure gas line, 036 (36) indicates turbine lines, 037 (37) is a water-cooled aftercooler for cooling high pressure gas discharged from the compressor before it is introduced to the heat exchanger in the cold box.

The systems of FIG. 1*b* and FIG. 1*c* basically operate as the system of FIG. 1*a* operates. High pressure high temperature helium gas discharged from the compressor 033 (33) enters the first stage 022 (22) of the heat exchanger in the cold box 021 (21) via the high pressure line 034 (34), where the high pressure high temperature gas is cooled by exchanging heat with low pressure low temperature gas flowing through the low pressure line 035 (35) in the first stage of the heat exchanger. The high pressure gas is cooled as it flows through the high pressure line passing sequentially through the second, third, . . . , and last stage of the heat exchanger, and enters the Joule-Thomson expansion valve 030 (30). Helium gas which entered the expansion turbine 028, 28 (029, 29) expands adiabatically therein to be reduced in pressure and temperature and joins the low pressure gas flowing in the low pressure line 035 (35). By this, temperature of the low pressure gas flowing through the low pressure line can be controlled to a desired temperature.

The high pressure, low temperature gas entered the Joule-Thomson expansion valve 030 (30) experiences Joule-Thomson expansion, lowered in temperature to 4K (−296° C.) which is boiling temperature, i.e. liquefying temperature of helium, and a portion of the helium is liquefied. The liquefied helium 032 (32) is separated in the gas/liquid separator 031 (31) and stored therein, and the remaining low pressure low temperature helium gas portion returns to the compressor 033

(33) flowing through the low pressure line 035 (35) passing through the stages 027 to 022 (26 to 22, 25 to 22) of the heat exchanger.

In the systems of FIG. 1*b* and FIG. 1*c* of the invention is provided an adsorption refrigerating machine 38 which utilizes waste heat generated in the compressor 33 as a heat source, and the high pressure gas cooled by the aftercooler 37 is further cooled by a heat exchanger 39 provided in the high pressure line 34 in the downstream side of the aftercooler 37 by a cooling medium which is produced by the adsorption refrigerating machine and supplied to the heat exchanger 39.

In the system of FIG. 1*c*, an ammonia refrigerating machine 40 is further provided, and a cooling medium produced by the ammonia refrigerating machine 40 is supplied to a heat exchanger provided in the high pressure line 34 in the downstream side of the heat exchanger 39 in order to further cool the high pressure gas before it enters the first stage 22 of the heat exchanger in the cold box 21. Temperatures are written-in in the drawings at each process.

In the system of FIG. 1*b* of the invention, the high pressure gas entering the first stage heat exchanger 22 is lowered to 10° C., and temperature of the low pressure gas entering the compressor is reduced to −3° C. due to reduced temperature of the high pressure gas entering the first stage heat exchanger 22. In the system of FIG. 1*c* of the invention, the high pressure gas entering the first stage heat exchanger is lowered to −26° C., and temperature of the low pressure gas entering the compressor is reduced to −39° C.

Power input to the compressor is reduced to 92% in the case of FIG. 1*b* and to 85% in the case of FIG. 1*c* as compared with 100% in the case of FIG. 1*a*. Further, the number of stages of the heat exchanger required to liquefy helium gas is reduced, and refrigerating efficiency of the total system is increased, for the absorption refrigerating machine 38 which utilizes waste heat generated in the compressor and the ammonia refrigerating machine 40 to cool the high pressure gas before it is introduced to the first stage heat exchanger 22 in the cold box 21.

According to the method of the invention, gas-to-be-liquefied discharged from a compressor and precooled is further cooled by a chemical refrigerating machine which utilizes waste heat generated in the compressor, so the gas is further reduced in temperature before it is introduced to a multiple-stage heat exchanger in a cold box. Therefore, temperature of low temperature low pressure gas returned to the compressor is reduced and specific volume of gas-to-be-liquefied sucked in by the compressor is reduced, and power input to the compressor can be reduced. Further, as waste heat generated in the compressor can be effectively utilized, thermal efficiency of total system can be markedly increased as compared with the cryogenic liquefying/regenerating system of prior art.

By further cooling the gas-to-be-liquefied cooled by the chemical refrigerating machine by a vapor compression refrigerating machine before the gas is introduced to the multiple-stage heat exchanger, temperature of the gas-to-be-liquefied supplied to the heat exchanger can be further lowered, and power input to the compressor can be further reduced.

According to the system of the invention, temperature of gas-to-be-liquefied introduced to the first stage of a multiple-stage heat exchanger in a cold box is reduced by providing a chemical refrigerating machine so that the gas is cooled in the downstream zone from an aftercooler and before introduced to the first stage of the heat exchanger. Therefore, temperature of low temperature low pressure gas returned to the compressor is reduced and specific volume of gas-to-be-liquefied sucked in by the compressor is reduced, and power input to the compressor can be reduced. Further, as waste heat generated in the compressor can be effectively utilized, thermal efficiency of total system can be markedly increased as compared with the cryogenic liquefying/refrigerating system of prior art.

Further, as temperature of the gas-to-be-liquefied supplied to the first stage of the multiple-stage heat exchanger in the cold box is reduced, the number of stages of the multiple-stage heat exchanger can be reduced, which contribute to downsizing of the system.

By providing a vapor refrigerating machine to further cool the gas-to-be-liquefied cooled by the chemical refrigerating machine before the gas is introduced to the multiple-stage heat exchanger, temperature of the gas-to-be-liquefied supplied to the heat exchanger can be further lowered, and power input to the compressor can be further reduced.

Further, by composing such that a portion of the cooling medium generated in the chemical refrigerating machine is supplied to the condenser of the vapor compression refrigerating machine as a cooling medium for the condenser in order to reduce condensing temperature of the refrigerant in the vapor compression refrigerating machine, pressure in the condensing process is reduced and refrigerating efficiency of the vapor compression refrigerating machine can be increased.

BRIEF DESCRIPTION OF THE DRAWINGS

The invention will be described in detail with reference to the following figures, wherein.

PREFERRED EMBODIMENTS OF THE INVENTION

Preferred embodiments of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

The First Embodiment

Figure 2:
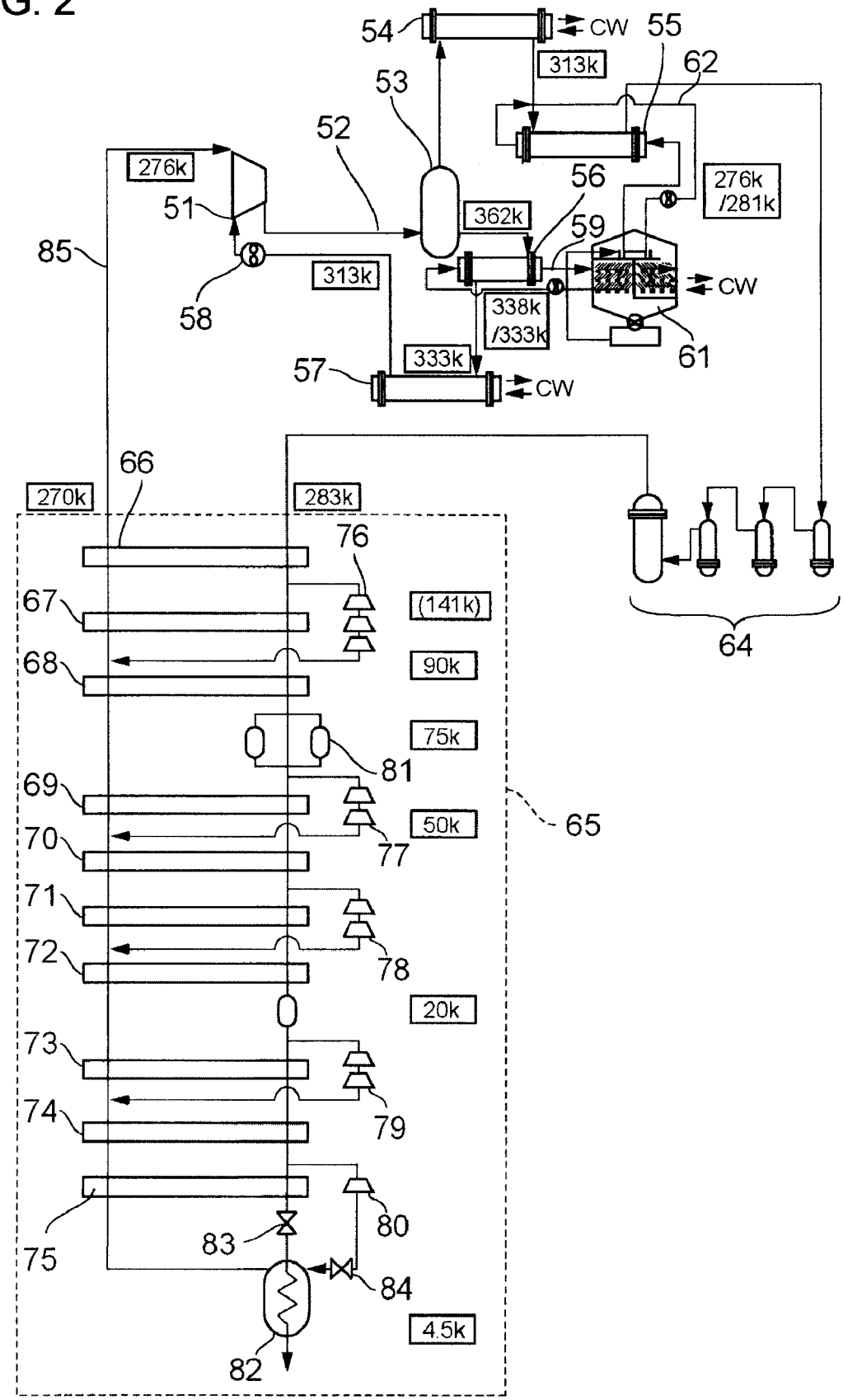
FIG. 2 is a schematic diagram of the first embodiment of the system according to the invention.

FIG. 2 is a schematic diagram of the first embodiment of the invention applied to a helium liquefying/refrigerating system. In the drawing, reference numeral 51 is a compressor, in a high pressure line 52 extending from the outlet thereof are provided an oil separator 53, a primary after cooler 54, a second after cooler 55 in this order. Lube oil of the compressor mixed in the high pressure gas discharged from the compressor 51 is separated in the oil separator 53, then the lube oil gives heat to hot water flowing through a hot water line 59 in a heat recovering device 56, then cooled in an oil cooler 57 and returned to the compressor 51 by means of an oil pump 58.

The high pressure gas got rid of lube oil in the oil separator 53 is cooled in a primary after cooler 54 and a secondary after cooler 55. The hot water heated by the lube oil and flowing in the hot water line 59 is introduced to an adsorption refrigerating machine 61 to be used as a heat source for driving the adsorption refrigerating machine 61. The adsorption refrigerating machine 61 is a one generally known, and low temperature water generated there is sent to the second after cooler via a low temperature circulation line 62 to be used as a cold source for cooling the high pressure gas.

The high pressure gas is supplied to a cold box 65 after it is cooled in the second after cooler 55 by way of a precision oil separator 64.

Figure 5:
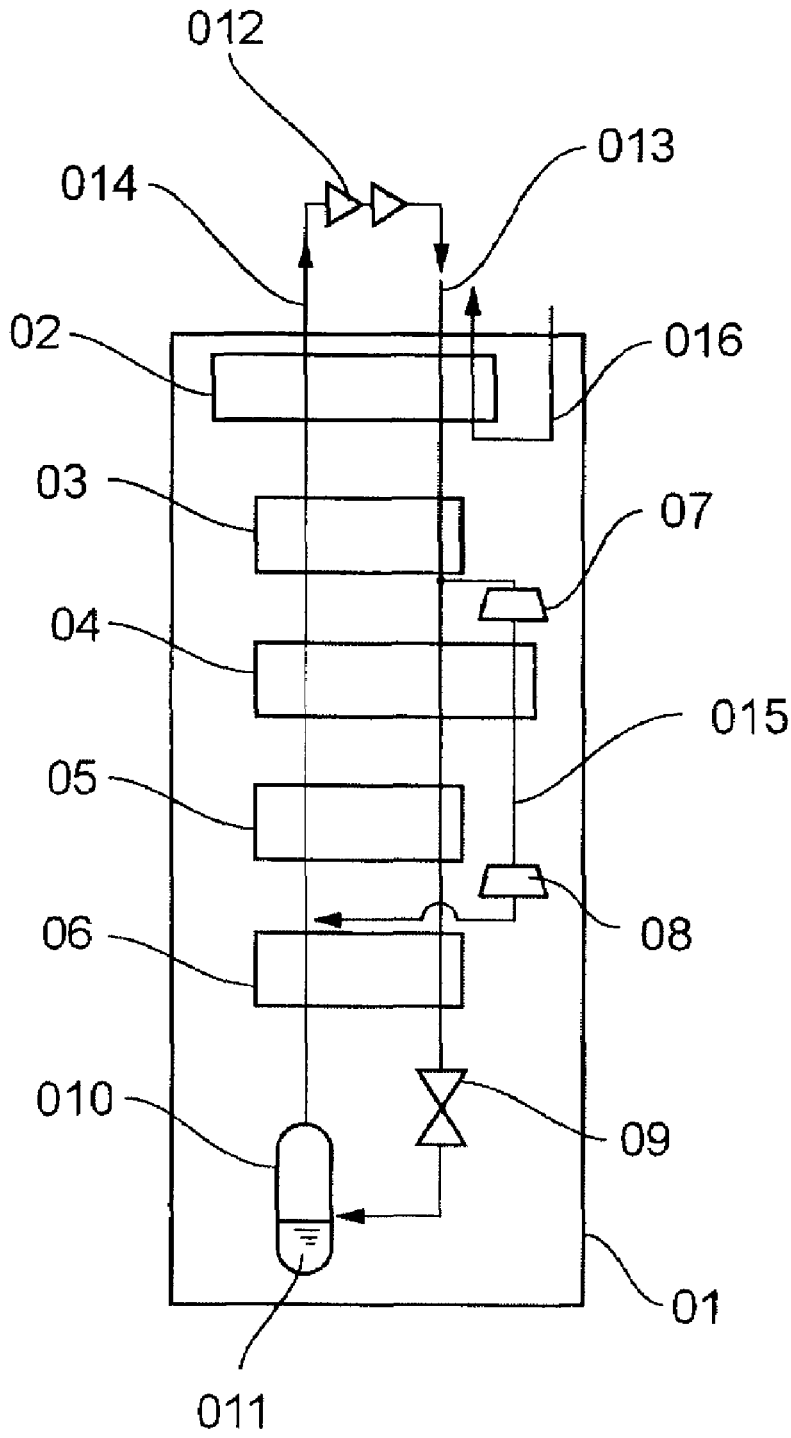
FIG. 5 Prior Art
FIG. 5 is a schematic diagram of a cryogenic liquefying/refrigerating system of prior art.

Heat exchangers 66~75 of $1^{st}$ stage to $10^{th}$ stage are arranged in the cold box 65. The high pressure gas exchanges heat in these heat exchangers with low pressure gas returning to the compressor 51. Reference numerals 76~79 are expansion turbines for allowing a portion of the high pressure gas branched from the high pressure line 52 passing through the heat exchangers 66~75 to expand adiabatically therein to be rendered low in temperature and pressure. Each of the gas exhausted from each of the expansion turbines is sent to the low pressure line 85 to be returned to the compressor 51 thereby maintaining the low pressure gas flowing through the low pressure line in low temperature. The expansion turbine 76 serves similarly as liquid nitrogen supplied through the precooling line 016 in the system of prior art shown in FIG. 5.

Reference numeral 80 is an expansion turbine for allowing a portion of the high pressure gas to expand adiabatically similarly as in the expansion turbines 76~79 to be rendered low in temperature and medium in pressure. The gas rendered low in temperature and medium in pressure is expanded through a Joule-Thomson (J/T) expansion valve 84, where the gas changes to a mixture of liquid and gas and fed into a gas-liquid separator 82. This subserves to cool the gas/liquid separator 82. The high pressure gas flowing through the high pressure line 52 expands through a J/T expansion valve 83, where the gas changes to a mixture of liquid and gas and fed into the gas-liquid separator 82. The liquid helium separated in the gas/liquid separator 82 may then be used to refrigerate a load not shown in the drawing. The gas of the liquid/gas helium mixture is drawn through the low pressure line 85 back through the heat exchangers 75~66 to the compressor 51. Reference numeral 81 is an impurities adsorbing device for removing impurities in the high pressure gas. Numerical values surrounded by quadrangles indicate temperature at each process.

According to the first embodiment, waste heat of the lube oil after lubricating the compressor 51 is recovered by the heat recovering device 56, and the high pressure gas discharged from the compressor 51 can be cooled by the low temperature water generated by the adsorption refrigerating machine 61 utilizing the waste heat of the lube oil.

As the high pressure gas discharged from the compressor 51 can be cooled in the secondary aftercooler 55 after it is cooled in the primary aftercooler 54 by said low temperature water, the high pressure gas can be reduced in temperature before it enters the cold box 65.

Therefore, as temperature of the low pressure gas returned to the compressor 51 can be lowered to a temperature about the same to that of the high pressure gas entering the cold box 65, specific volume of gas sucked by the compressor 51 can be reduced, as a result power input to the compressor 51 can be reduced, and as temperature of the high pressure gas entering the cold box can be reduced, the number of the heat exchangers for liquefying helium gas can be reduced and downsizing of the cold box can be attained.

Further, as the heat that the lube oil received in the compressor 51 is recovered and utilized as a heat source for the adsorption refrigerating machine 61, refrigerating efficiency of the total system can be increased.

The Second Embodiment

Figure 3:
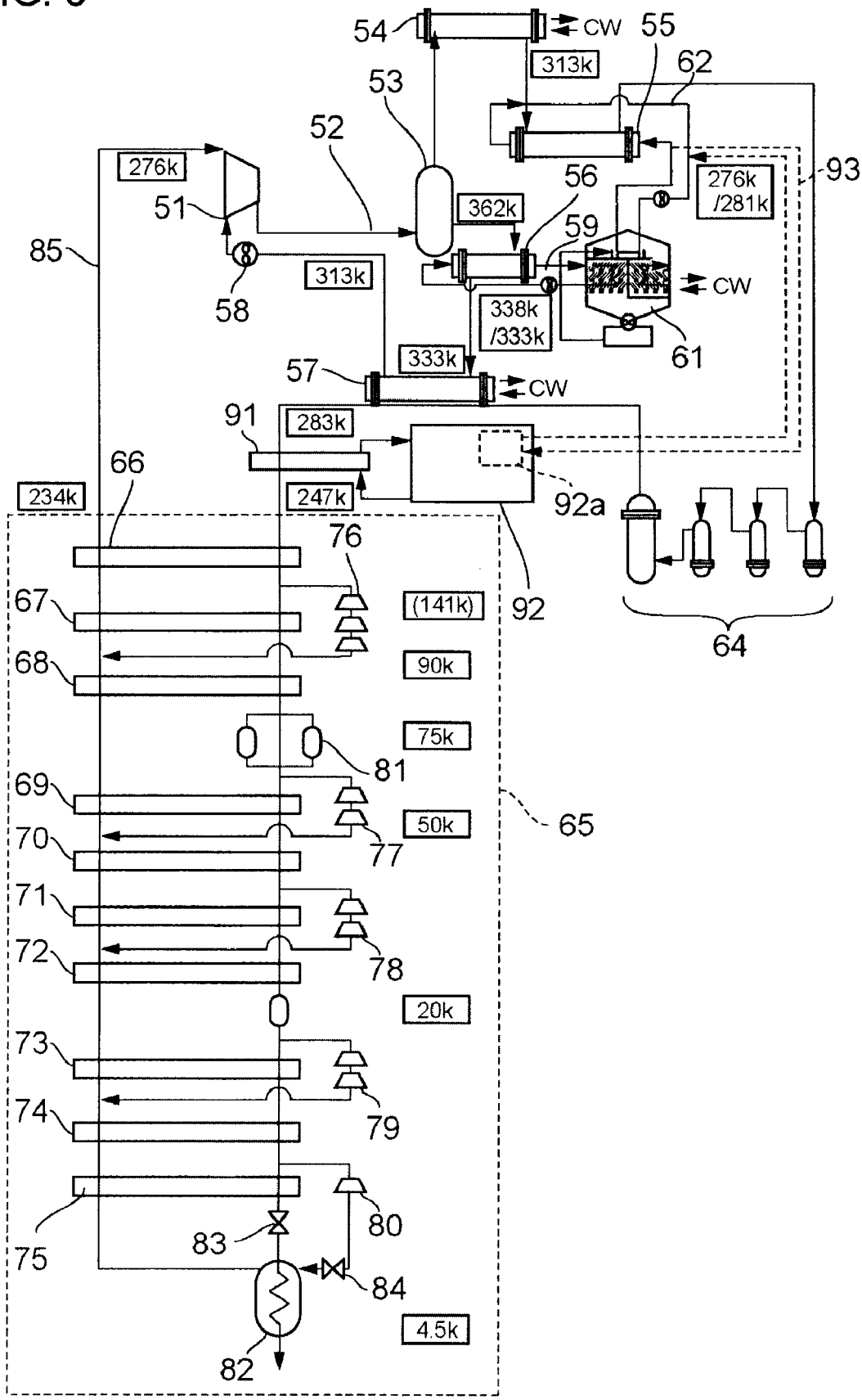
FIG. 3 is a schematic diagram of the second embodiment of the system according to the invention.

Next, the second embodiment of the system according to the invention will be explained with reference to FIG. 3. The second embodiment is different from the first embodiment shown in FIG. 2 in that a heat exchanger 91 is added in the downstream side of the precision oil separator 64 in the high pressure line 52 and further an ammonia refrigerating machine 92 as a vapor compression refrigerating machine for supplying low temperature refrigerant to the heat exchanger 91 and a branch line 93 are added, other configuration is the same as that of the first embodiment. In FIG. 3, numerical values surrounded by quadrangles indicate temperature at each process.

In the second embodiment, the high pressure gas which was precooled in the secondary aftercooler 55 and passed through the precision oil separator 64 is further cooled in the heat exchanger 91 by the refrigerant supplied from the ammonia refrigerating machine 92. A portion of the low temperature water is supplied from the adsorption refrigerating machine 61 to a condenser 92*a* of the ammonia refrigerating machine 92 via the branch line 93. By this, condensing temperature in the ammonia refrigerating machine is lowered and pressure in the condensing process is reduced resulting in increased refrigerating efficiency of the ammonia refrigerating machine.

According to the second embodiment, the same working and effect as the first embodiment is attained, and in addition to that the high pressure gas entering the cold box 65 can be further reduced in temperature, accordingly power input to the compressor can be further reduced and the number of the heat exchangers in the cold box 65 can be further reduced.

Further, as the ammonia refrigerating machine 92 utilizes cold energy of the low temperature water of the adsorption refrigerating machine 61, refrigerating efficiency of the total system can be largely increased.

Figures 1A, 1B, 1C:
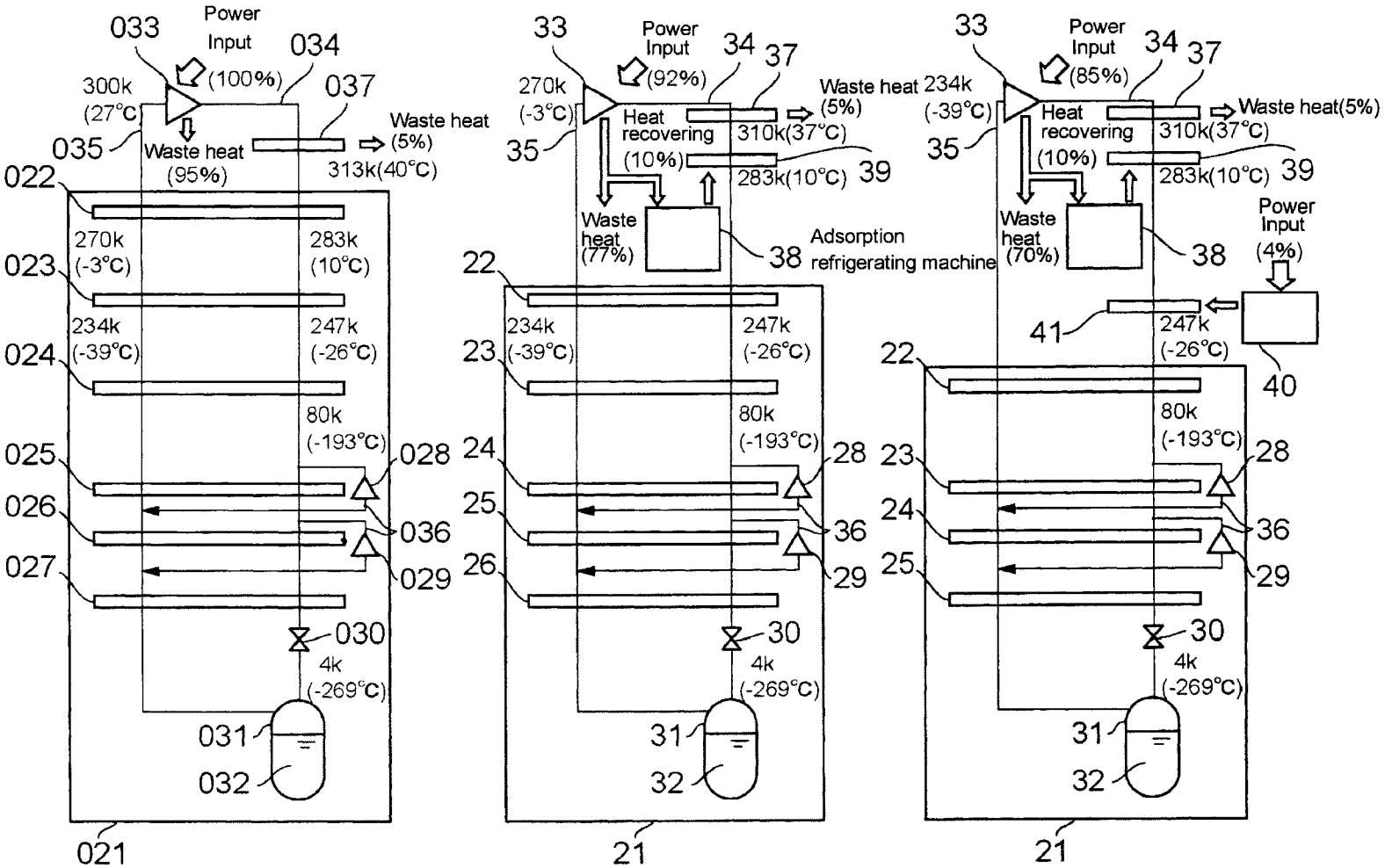
FIG. 1a Prior Art
FIGS. 1*a*, 1*b*, and 1*c* are schematic diagrams for explaining the basic configuration of the system according to the present invention comparing with a system of prior art.

The first embodiment corresponds to the system of FIG. 1*b*, and the second embodiment corresponds to the system of FIG. 1*c*. As shown by numerical values in the drawings, power input to the compressor is reduced by about 8% in the system of FIG. 1*b*, by about 15% in the system of FIG. 1*c* as compared with the system of prior art shown in FIG. 1*a*.

System efficiency FOM (1/COP (coefficient of performance): power input required to drive the compressor per unit volume) is improved as compared with the prior art system of FIG. 1*a* by about 8% in the system of FIG. 1*b* and by about 11% in the system of FIG. 1*c*.

The Third Embodiment

Figure 4:
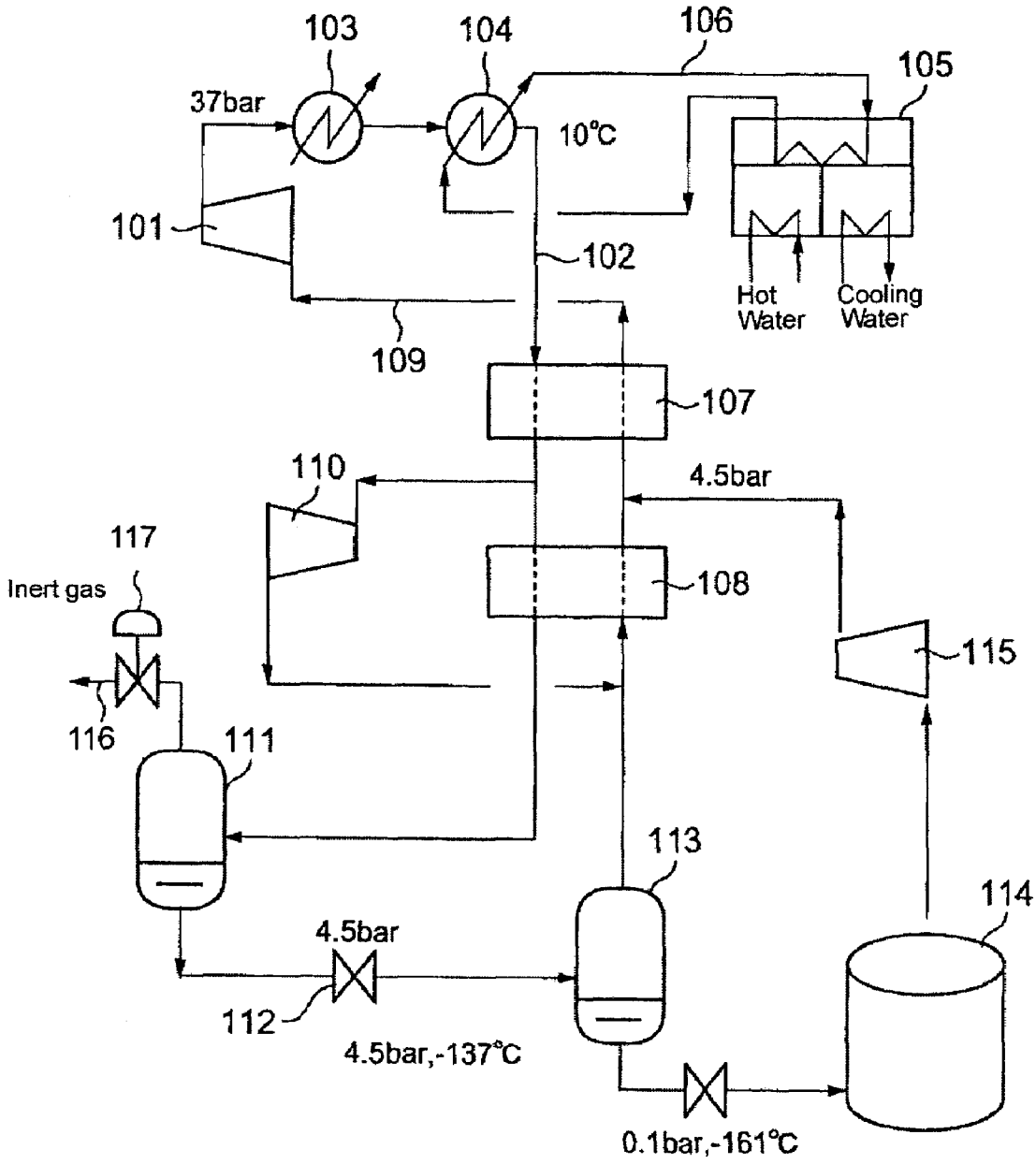
FIG. 4 is a schematic diagram of the third embodiment of the system according to the invention.

Next, the third embodiment in a case the present invention is applied to a re-liquefying system of natural gas will be explained referring to FIG. 4. In the drawing, reference numeral 101 is a compressor. A primary aftercooler 103 and a secondary aftercooler 104 are provided in this order in a high pressure gas line 102. High pressure gas discharged from the compressor 101 is cooled by these aftercoolers. Reference numeral 105 is a chemical refrigerating machine such as an adsorption refrigerating machine or absorption refrigerating machine, by which cold water is produced utilizing waste heat such as friction loss heat that lube oil received during lubrication of the compressor 101 and retained in the lube oil, in the same way as is by the adsorption refrigerating machine in the first and second embodiment. Said cold water is supplied via a circulation line 106 to the secondary aftercooler 104 as a cold source.

Reference numeral 107 is a first stage heat exchanger, 108 is a second stage heat exchanger. The high pressure gas flowing through the high pressure line 102 is cooled in the heat exchangers 107 and 108 by exchanging heat with low pressure gas returning to the compressor 101 through a low pressure gas line 109. Reference numeral 110 is an expansion turbine in which a portion of the high pressure gas branched from the high pressure line 102 is expanded adiabatically to be reduced in temperature and pressure, and the gas reduced in temperature and pressure is supplied to the low pressure gas line 109 in the upstream part from the second stage heat exchanger 108 to maintain low temperature of the gas returning to the compressor 101 through the low pressure line. Reference numeral 111 is a head tank in which a small amount of impure gas (mainly consisting of air and called inert gas) contained in gases evaporated in a cargo tank 114 mentioned later for storing liquefied natural gas (LNG) is pooled, and the pooled inert gas are released outside through a pipe line 116 by opening a valve 117 as necessary.

The high pressure gas flowing through the high pressure gas line 102 passes through the head tank 111 and through a Joule-Thomson expansion valve 112 and supplied to a gas/liquid separator 113 as low temperature medium pressure gas. A portion of the gas supplied to the gas/liquid separator 113 is liquefied due to low temperature and the gas is changed to a mixture of liquid and gas in the gas/liquid separator 113. The natural gas in the gas/liquid separator 113 is returned to the compressor 101 via the lower pressure gas line 109. The liquid natural gas in the gas/liquid separator 113 is transferred to the cargo tank 114 to be stored therein. Evaporated gas in the cargo tank 114 is compressed by a BOG (boiled-off gas) compressor 115, introduced to the low pressure gas line 109 at the upstream side of the first stage heat exchanger 107, and serves to cool the high pressure gas in the first stage heat exchanger 107. The evaporated gas in the cargo tank 114 is methane which contains a small amount of impure gases (mainly air). These impure gases are pooled in the head tank 111 as mentioned above. In FIG. 4, pressure and temperature at each of processing parts are written-in in the drawing.

According to the third embodiment, as high pressure gas discharged from the compressor 101 is cooled in the primary aftercooler 103 and then further cooled in the secondary aftercooler 104 by the cold water produced by the chemical refrigerating machine 105, high pressure gas entering the first stage heat exchanger 107 can be reduced in temperature.

Therefore, as low pressure gas returning to the compressor 101 through the low pressure gas line 109 can be reduced to about the same temperature as that of the high pressure gas entering the first stage heat exchanger 107, specific volume of gas sucked into the compressor 101 can be reduced, as a result power input to the compressor 101 can be reduced, and at the same time high pressure gas entering the first stage heat exchanger 107 can be reduced in temperature. Accordingly, the number of heat exchangers required to liquefy natural gas can be reduced, which contributes to downsizing of the system.

Further, as the chemical refrigerating machine 105 is operated by utilizing waste heat such as friction loss heat that lube oil received during lubrication of the compressor 101, refrigerating efficiency of the total system can be increased.

According to the present invention, in a refrigerating system for cryogenic liquefying gas with extremely low boiling temperature such as helium and natural gas, gas temperature at the inlet of the compressor can be lowered and power input to the compressor can be effectively reduced, by utilizing waste heat generated in the compressor and sensible heat of the gas discharged from the compressor, which is conventionally not utilized, as a heat source for a chemical refrigerating machine or vapor compression refrigerating machine to produce cold energy to precool the gas discharged from the compressor and lower gas temperature at the inlet of the compressor. In this manner, a liquefying/refrigerating method and system for minimizing total power required for the operation of the system can be realized.

What is claimed is:

1. A method of cryogenic liquefying/refrigerating comprising the steps of;

precooling high temperature high pressure gas-to-be-liquefied that is compressed and discharged from an oil-lubricated compressor, introducing the gas to a multiple-stage heat exchanger to be cooled sequentially, liquefying a portion of the gas by allowing the gas to expand adiabatically, and using low temperature low pressure gas not liquefied as cooling medium in said heat exchanger and then returning the gas to the oil-lubricated compressor;

wherein said gas compressed by the oil-lubricated compressor and precooled is further cooled by a chemical refrigerating machine which utilizes, as a heat source, heat contained in lubrication oil used by the oil-lubricated compressor.

2. A method of cryogenic liquefying/refrigerating as claimed in claim 1, wherein said high pressure gas-to-be-liquefied cooled by said chemical refrigerating machine is further cooled by a vapor compression refrigerating machine, then the gas is introduced to the multiple stages of the heat exchanger.

3. A cryogenic liquefying/refrigerating system comprising;

an oil-lubricated compressor for compressing a gas-to-be-liquefied with high temperature and high pressure, an oil separator for separating lubrication oil mixed in with the high temperature and high pressure gas-to-be liquefied, an after cooler for precooling the gas from which the lubrication oil has been separated, a multiple-stage heat exchanger for sequentially cooling the precooled gas, an expansion valve for expanding the gas cooled in the multiple-stage heat exchanger to be changed to a mixture of liquid and gas, a gas/liquid separator for storing the mixture of liquid and gas, a return passage for returning the gas separated from the liquid in the gas/liquid separator to the compressor after it served as a cooling medium for the multiple-stage heat exchanger; and a heat recovering device that recovers heat from the lubrication oil separated by the oil separator, wherein a chemical refrigerating machine is further provided which utilizes as its heatsource the heat recovered by the heat recovering device to further precool the gas precooled by the aftercooler.

4. A cryogenic liquefying/refrigerating system as claimed in claim 3, further comprising a vapor compression refrigerating machine to further cool the gas precooled by said chemical refrigerating machine before it enters the multiple-stage heat exchanger.

5. A cryogenic liquefying/refrigerating system as claimed in claim 4, wherein a portion of a low temperature cooling medium cooled by said chemical refrigerating machine is supplied to a condenser of said vapor compression refrigerating machine as a cooling medium for the condenser.

6. A cryogenic liquefying/refrigerating system as claimed in claim 3, further comprising;

a cargo tank for storing the liquefied gas introduced from the gas/liquid separator, a compressor for compressing boiled-off gas evaporated in said cargo tank, and a precooling line for introducing the boiled-off gas to said compressor and introducing the compressed boiled-off gas to the first stage of the multiple stage heat exchanger as a cooling medium.

7. A method of cryogenic liquefying/refrigerating as claimed in claim 1, further comprising obtaining the heat in the lubrication oil by utilizing a heat recovering device that recovers the heat in the lubrication oil after the lubrication oil has been separated from the high temperature and high pressure gas-to-be-liquefied by an oil separator.

8. A cryogenic liquefying/refrigerating system as claimed in claim 3, wherein the heat recovering device is disposed between a lubrication oil discharge port of the oil separator.

* * * * *